US010242795B2

(12) United States Patent
Sakuma et al.

(10) Patent No.: US 10,242,795 B2
(45) **Date of Patent: *Mar. 26, 2019**

(54) METHOD OF MANUFACTURING RARE EARTH MAGNET

(71) Applicant: TOYOTA JIDOSHA KABUSHIKI KAISHA, Toyota-shi, Aichi-ken (JP)

(72) Inventors: Noritsugu Sakuma, Toyota (JP); Tetsuya Shoji, Toyota (JP); Daisuke Sakuma, Toyota (JP); Kazuaki Haga, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 29 days.

This patent is subject to a terminal disclaimer.

(21) Appl. No.: 15/107,603

(22) PCT Filed: Dec. 19, 2014

(86) PCT No.: PCT/IB2014/002836

§ 371 (c)(1),
(2) Date: Jun. 23, 2016

(87) PCT Pub. No.: WO2015/097523

PCT Pub. Date: Jul. 2, 2015

(65) Prior Publication Data

US 2016/0322159 A1 Nov. 3, 2016

(30) Foreign Application Priority Data

Dec. 26, 2013 (JP) ..... 2013-269204

(51) Int. Cl.
*H01F 1/053* (2006.01)
*H01F 1/057* (2006.01)
(Continued)

(52) U.S. Cl.
CPC ..... *H01F 41/0266* (2013.01); *B22F 3/10* (2013.01); *C22C 38/002* (2013.01);
(Continued)

(58) Field of Classification Search
CPC ..... H01F 1/0536; H01F 1/057; H01F 1/0576; H01F 1/0577; H01F 41/0266;
(Continued)

(56) References Cited

U.S. PATENT DOCUMENTS 5,387,291 A 2/1995 Kaneko et al.
5,405,455 A 4/1995 Kusunoki et al.
(Continued)

FOREIGN PATENT DOCUMENTS

CN 102308343 A 1/2012
CN 103098155 A 5/2013
(Continued)

OTHER PUBLICATIONS

Office Action dated Jul. 10, 2017 from U.S. Patent & Trademark Office in counterpart U.S. Appl. No. 14/859,579.
(Continued)

*Primary Examiner* — Colleen P Dunn
*Assistant Examiner* — Anthony M Liang
(74) *Attorney, Agent, or Firm* — Sughrue Mion, PLLC

(57) ABSTRACT

A manufacturing method includes: manufacturing a sintered compact having a composition of $(Rl)_x(Rh)_yT_zB_sM_t$; manufacturing a precursor by performing hot deformation processing on the sintered compact; and manufacturing a rare earth magnet by performing an aging treatment on the precursor in a temperature range of 450° C. to 700° C. In this method, a main phase thereof is formed of a $(RlRh)_2T_{14}B$ phase. A content of a $(RlRh)_{1.1}T_4B_4$ phase in a grain boundary phase thereof is more than 0 mass % and 50 mass % or less. Rl represents a light rare earth element. Rh represents
(Continued)

a heavy rare earth element. T represents a transition metal. M represents at least one of Ga, Al, Cu, and Co. x, y, z, s, and t are percentages by mass of Rl, Rh, T, B, and M. x, y, z, s, and t are expressed by the following expressions: $27 \leq x \leq 44$, $0 \leq y \leq 10$, $z=100-x-y-s-t$, $0.75 \leq s \leq 3.4$, $0 \leq t \leq 3$.

2 Claims, 7 Drawing Sheets

(51) Int. Cl.

| | |
|---|---|
| ***H01F 41/02*** | (2006.01) |
| ***C22C 38/00*** | (2006.01) |
| ***C22C 38/06*** | (2006.01) |
| ***C22C 38/16*** | (2006.01) |
| ***C22F 1/16*** | (2006.01) |
| ***B22F 3/10*** | (2006.01) |

(52) U.S. Cl.
CPC ..... *C22C 38/005* (2013.01); *C22C 38/06* (2013.01); *C22C 38/16* (2013.01); *C22F 1/16* (2013.01); *H01F 1/057* (2013.01); *H01F 1/0536* (2013.01); *H01F 1/0576* (2013.01); *H01F 1/0577* (2013.01); *H01F 41/0293* (2013.01); *B22F 2998/10* (2013.01); *C22C 2202/02* (2013.01)

(58) Field of Classification Search
CPC .... H01F 41/0293; B22F 2998/10; B22F 3/10; B22F 2003/248; B22F 2003/185; B22F 2003/208; C22C 2202/02; C22C 38/002; C22C 38/005; C22C 38/06; C22C 38/16; C22F 1/16
See application file for complete search history.

(56) References Cited

U.S. PATENT DOCUMENTS

| | | | |
|---|---|---|---|
| 2004/0020563 | A1 | 2/2004 | Tokuhara et al. |
| 2004/0025974 | A1 | 2/2004 | Lee et al. |
| 2010/0003156 | A1 | 1/2010 | Suzuki et al. |
| 2010/0233016 | A1 | 9/2010 | Tsubokura et al. |
| 2011/0286878 | A1 | 11/2011 | Kishimoto et al. |
| 2013/0078369 | A1 | 3/2013 | Shoji et al. |
| 2013/0248754 | A1 | 9/2013 | Sakuma et al. |
| 2013/0323111 | A1 | 12/2013 | Miyamoto et al. |
| 2014/0238553 | A1 | 8/2014 | Sakuma et al. |
| 2014/0242267 | A1 | 8/2014 | Shoji et al. |
| 2016/0314899 | A1 | 10/2016 | Sakuma et al. |
| 2016/0322159 | A1 | 11/2016 | Sakuma et al. |

FOREIGN PATENT DOCUMENTS

| | | | |
|---|---|---|---|
| CN | 103189943 | A | 7/2013 |
| CN | 104979062 | A | 10/2015 |
| CN | 105118593 | A | 12/2015 |
| CN | 105679482 | A | 6/2016 |
| CN | 105845306 | A | 8/2016 |
| EP | 1 641 000 | A1 | 3/2006 |
| EP | 1 961 506 | A1 | 8/2008 |
| EP | 2 388 350 | A1 | 11/2011 |
| JP | 05-267027 | A | 10/1993 |
| JP | 06-207203 | A | 7/1994 |
| JP | 2853839 | B2 | 11/1998 |
| JP | 2005-527989 | A | 9/2005 |
| JP | 2010-263172 | A | 11/2010 |
| JP | 2011-216659 | A | 10/2011 |
| JP | 2012-023190 | A | 2/2012 |
| JP | 2012-244111 | A | 12/2012 |
| JP | 2013-149862 | A | 8/2013 |
| JP | 2013-197414 | A | 9/2013 |
| JP | 2015-119074 | A | 6/2015 |
| JP | 2015-126081 | A | 7/2015 |
| WO | 2012/008623 | A1 | 1/2012 |
| WO | 2012/036294 | A | 3/2012 |
| WO | 2012/114530 | A1 | 8/2012 |
| WO | 2013/054779 | A1 | 4/2013 |
| WO | 2013/072728 | A1 | 5/2013 |
| WO | 2013/073486 | A1 | 5/2013 |

OTHER PUBLICATIONS

Office Action dated Dec. 11, 2017 from U.S. Patent & Trademark Office in counterpart U.S. Appl. No. 15/104,369.
U.S. Advisory Action dated Aug. 6, 2018, issued by the USPTO in U.S. Appl. No. 15/104,369.
Final Office Action dated Apr. 27, 2018, issued by the U.S. Patent & Trademark Office in U.S. Appl. No. 15/104,369.
Non-Final Office Action dated Oct. 26, 2018, which issued during the prosecution of US Patent and Trademark Office U.S. Appl. No. 15/104,369.

METHOD OF MANUFACTURING RARE EARTH MAGNET

BACKGROUND OF THE INVENTION

1. Field of the Invention

The present invention relates to a method of manufacturing a rare earth magnet.

2. Description of Related Art

Rare earth magnets made from rare earth elements are called permanent magnets and are used for driving motors of hybrid vehicles, electric vehicles, and the like as well as motors included in hard disks and MRIs.

As an index indicating magnet performance of these rare earth magnets, for example, remanent magnetization (remanent magnetic flux density) and coercive force may be used. Along with a decrease in the size of a motor and an increase in current density, the amount of heat generation increases, and thus the demand for high heat resistance has further increased in rare earth magnets to be used. Accordingly, one of the important research issues in this technical field is how to hold the coercive force of a magnet when being used at a high temperature. A Nd—Fe—B-based magnet which is a rare earth magnet widely used in a vehicle driving motor will be described as an example. In this Nd—Fe—B-based magnet, an attempt to increase the coercive force thereof has been made, for example, by refining crystal grains, by using an alloy composition having a large amount of Nd, or by adding a heavy rare earth element such as Dy or Tb having high coercive force performance.

Examples of the rare earth magnets include commonly-used sintered magnets in which a grain size of crystal grains constituting a structure thereof is about 3 μm to 5 μm; and nanocrystalline magnets in which crystal grains are refined into a nano grain size of about 50 nm to 300 nm.

In order to improve the coercive force among magnetic properties of such a rare earth magnet, PCT International Publication WO 2011/008623 discloses a method in which, for example, a Nd—Cu alloy or a Nd—Al alloy is diffused and infiltrated into a grain boundary phase as a modified alloy containing a transition metal element or the like and a light rare earth element to modify the grain boundary phase.

Since the modified alloy containing a transition metal element or the like and a light rare earth element does not contain a heavy rare earth element such as Dy, the modified alloy has a low melting point, is melted even at about 700° C., and can be diffused and infiltrated into the grain boundary phase. Accordingly, in the case of nanocrystalline magnets having a grain size of about 300 nm or less, it can be said that the above processing method is preferable because coercive force performance can be improved by modifying the grain boundary phase while suppressing the coarsening of crystal grains.

However, when the Nd—Cu alloy or the like is diffused and infiltrated into the grain boundary phase, in order for the Nd—Cu alloy or the like to be diffused and infiltrated into the center region of the magnet, it is necessary that the infiltration amount of the Nd—Cu alloy or the like or the heat treatment time be increased.

In this case, the Nd—Cu alloy itself is a non-magnetic alloy, and thus when the infiltration amount of the Nd—Cu alloy or the like to be diffused and infiltrated is increased, the content of a non-magnetic alloy in the magnet is increased, which leads to a decrease in the remanent magnetization of the magnet. In addition, an increase in the infiltration amount of the Nd—Cu alloy or the like causes an increase in material cost.

In addition, the diffusion and infiltration of the Nd—Cu alloy or the like using a long-term heat treatment leads to an increase in the manufacturing time and cost of a magnet.

On the other hand, instead of the diffusion and infiltration of the modified alloy, PCT International Publication WO 2012/036294 discloses a method of manufacturing a rare earth magnet in which a heat treatment is performed on a rare earth magnet precursor subjected to hot deformation processing at a temperature, which is sufficiently high for causing a grain boundary phase to be diffused or flow and is sufficiently low for preventing the coarsening of crystal grains, such that a grain boundary phase concentrated on triple points of crystal grains is sufficiently infiltrated into a grain boundary other than the triple points to cover each crystal grain, thereby improving coercive force performance. Such a heat treatment may be also called an optimization heat treatment or an aging treatment.

The low temperature during the aging treatment defined herein is about 700° C. at the highest as in the case of PCT International Publication WO 2012/008623. In order to cause the grain boundary phase to be diffused or flow at such a low temperature, a rare earth magnet composition is represented by, for example, $Nd_{15}Fe_{77}B_7Ga$, and a rare earth magnet is manufactured from a composition material having a Nd-rich grain boundary phase.

However, the manufacturing method disclosed in PCT International Publication WO 2012/036294 mainly focuses on the improvement of coercive force performance. Therefore, whether or not a rare earth magnet which is superior in both coercive force performance and magnetization performance can be manufactured with this manufacturing method is unclear.

SUMMARY OF THE INVENTION

The present invention has been made to provide a method of manufacturing a rare earth magnet, the method being capable of manufacturing a rare earth magnet which is superior in both coercive force performance and magnetization performance.

According to an aspect of the invention, there is provided a method of manufacturing a rare earth magnet including: manufacturing a sintered compact having a structure represented by a composition of $(Rl)_x(Rh))_yT_zB_sM_t$; manufacturing a rare earth magnet precursor by performing hot deformation processing on the sintered compact; and manufacturing a rare earth magnet by performing an aging treatment on the rare earth magnet precursor in a temperature range of 450° C. to 700° C. In this method, a main phase of the structure is formed of a $(RlRh)_2T_{14}B$ phase. A content of a $(RlRh)_{1.1}T_4B_4$ phase in a grain boundary phase of the structure is more than 0 mass % and 50 mass % or less. Rl represents at least one of light rare earth elements containing Y. Rh represents at least one of heavy rare earth elements containing Dy and Tb. T represents a transition metal containing at least one of Fe and Co. B represents boron. M represents at least one of Ga, Al, Cu, and Co. x, y, z, s, and t respectively represent percentages by mass of Rl, Rh, T, B, and M in the sintered compact. x, y, z, s, and t are expressed by the following expressions: $27 \le x \le 44$, $0 \le y \le 10$, $z=100-x-y-s-t$, $0.75 \le s \le 3.4$, $0 \le t \le 3$.

In the method of manufacturing a rare earth magnet according to the aspect of the invention, the content of the $(RlRh)_{1.1}T_4B_4$ phase in the grain boundary phase is defined to be in a range of more than 0 mass % and 50 mass % or less, and the grain boundary phase contains at least one of Ga, Al, Cu, and Co in addition to Nd or the like. In addition, the aging treatment is performed on the rare earth magnet precursor subjected to hot deformation processing in the temperature range of 450° C. to 700° C. As a result, by Nd or the like and Ga, Al, Cu, Co, or the like in the grain boundary phase being alloyed by the aging treatment, the grain boundary phase is modified, and a decrease in magnetization is suppressed. Accordingly, with the method of manufacturing a rare earth magnet according to the aspect of the invention, a rare earth magnet which is superior in both coercive force performance and magnetization performance can be manufactured.

Here, the rare earth magnet which is a manufacturing target of the manufacturing method according to the aspect of the invention includes a nanocrystalline magnet in which a grain size of a main phase (crystal) constituting a structure thereof is about 300 nm or less; and a sintered magnet having a grain size of more than 300 nm or a grain size of 1 μm or more.

In the manufacturing method according to the aspect, first, magnetic powder which is represented by the above-described composition and has a structure including the main phase and the grain boundary phase is manufactured. For example, magnetic powder for a rare earth magnet may be prepared by preparing a rapidly-solidified ribbon, which is fine crystal grains, by rapid solidification and crushing the rapidly-solidified ribbon.

This magnetic powder is filled into, for example, a die and is sintered while being compressed by a punch to be bulked. As a result, an isotropic sintered compact is obtained. This sintered compact has a metallographic structure that includes a RE-Fe—B main phase of a nanocrystalline structure and a grain boundary phase of an RE-X alloy (X: metal element) present around the main phase. Here, RE represents at least one of Nd and Pr, more specifically, one element or two or more elements selected from Nd, Pr, and Nd—Pr. The grain boundary phase contains at least one of Ga, Al, Cu, and Co in addition to Nd or the like and contains a $(RlRh)_{1.1}T_4B_4$ phase, for example, $Nd_{1.1}Fe_4B_4$ in a content range of 50 mass % or less.

The present inventors have specified that, by the grain boundary phase containing $Nd_{1.1}Fe_4B_4$ in a content range of 50 mass % or less, that is, by controlling the B content in the grain boundary phase to be in a predetermined range, a decrease in the content of the main phase during the aging treatment is suppressed and thus a decrease in magnetization is suppressed.

Next, hot deformation processing is performed on the isotropic sintered compact to impart magnetic anisotropy thereto. Examples of the hot deformation processing include upset forging and extrusion forging (forward extrusion forging and backward extrusion forging). A processing strain is introduced into the sintered compact by using one method or a combination of two or more methods among the above-described hot deformation processing methods. Next, for example, high deformation is performed at a processing rate of 60% to 80%. As a result, a rare earth magnet having high orientation and superior magnetization performance is manufactured.

As described above, a rare earth magnet is manufactured by performing the aging treatment on the manufactured rare earth magnet precursor in the temperature range of 450° C. to 700° C.

The grain boundary phase constituting the rare earth magnet precursor contains at least one of Ga, Al, Cu, and Co in addition to Nd or the like. Therefore, the grain boundary phase can be melted and flow in the low temperature range of 450° C. to 700° C., and Nd or the like and Ga, Al, Cu, Co, or the like can be alloyed. That is, by alloying a transition metal element or the like and a light rare earth element contained in the grain boundary phase in advance, the same modification effects as in the case where the modified alloy is diffused and infiltrated can be exhibited without the necessity of diffusing and infiltrating the modified alloy into the surface of a magnet.

In this way, in the method of manufacturing a rare earth magnet according to the aspect of the invention, the grain boundary phase in the entire region of a magnet can be modified by the aging treatment (or the optimization treatment) without the necessity of diffusing and infiltrating the modified alloy thereinto. As a result, coercive force can be improved. In addition, by the grain boundary phase containing boron in a predetermined amount, a decrease in the content of the main phase can be suppressed, and a decrease in magnetization can be suppressed.

In addition, in the method of manufacturing a rare earth magnet according to the aspect of the invention, during the aging treatment, a modified alloy containing a light rare earth element and at least one of a transition metal element, In, Zn, Al, and Ga may be diffused and infiltrated into the grain boundary phase.

By diffusing and infiltrating the modified alloy into the grain boundary phase during the aging treatment, the grain boundary phase of the surface region of the rare earth magnet precursor in which the modified alloy is easily diffused and infiltrated is further modified.

The modification of the grain boundary phase, which is performed by alloying a transition metal element or the like and a light rare earth element present in the grain boundary phase in advance, is performed on the grain boundary phase of the entire region of the rare earth magnet precursor. Accordingly, the modification of the grain boundary phase can be sufficiently performed on a center region of the rare earth magnet precursor without the necessity of diffusing and infiltrating the modified alloy into the center region.

By using the modified alloy containing a light rare earth element and at least one of a transition metal element, In, Zn, Al, and Ga, when the aging treatment is performed in the relatively low temperature range of 450° C. to 700° C., the melting and the diffusion and infiltration into the grain boundary phase of the modified alloy; and the alloying of a transition metal element or the like and a light rare earth element in the grain boundary phase can be performed at the same time.

In the method of manufacturing a rare earth magnet according to the aspect of the invention, a modified alloy having a melting point or a eutectic point in the temperature range of 450° C. to 700° C. may be an alloy containing a light rare earth element such as Nd or Pr and an element such as Cu, Co, Mn, In, Zn, Al, Ag, Ga, or Fe.

By diffusing and infiltrating the modified alloy into the grain boundary phase in this way, the grain boundary phase of, particularly, a surface region of a magnet (for example, when the distance from the center to the surface of a magnet is represented by s, a range of s/3 and a range of 2s/3 may be defined as a center region and a surface region, respectively) can be modified. That is, the grain boundary phase of the entire region of the magnet can be modified by the alloying of a transition metal element or the like and a light rare earth element in the grain boundary phase. Therefore, it is not necessary that the non-magnetic modified alloy be diffused and infiltrated into the center region of the magnet to modify the grain boundary phase.

As described above, in the method of manufacturing a rare earth magnet according to the aspect of the invention, the content of the $(RlRh)_{1.1}T_4B_4$ phase in the grain boundary phase is defined to be in a range of more than 0 mass % and 50 mass % or less. In addition, the grain boundary phase contains at least one of Ga, Al, Cu, and Co in addition to Nd or the like. In addition, the grain boundary phase is modified by performing the aging treatment on the rare earth magnet precursor subjected to hot deformation processing in the temperature range of 450° C. to 700° C. such that Nd or the like and Ga, Al, Cu, Co, or the like in the grain boundary phase are alloyed by the aging treatment. Therefore, in the method of manufacturing a rare earth magnet according to the aspect of the invention, a decrease in magnetization can be suppressed, and a rare earth magnet which is superior in both magnetization performance and coercive force performance can be manufactured. In addition, the coercive force of a surface region of a magnet can be further improved by diffusing and infiltrating a modified alloy containing a light rare earth element and at least one of a transition metal element, In, Zn, Al, and Ga into the grain boundary phase during the aging treatment.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS (Embodiment of Method of Manufacturing Rare Earth Magnet)

Figure 1A:
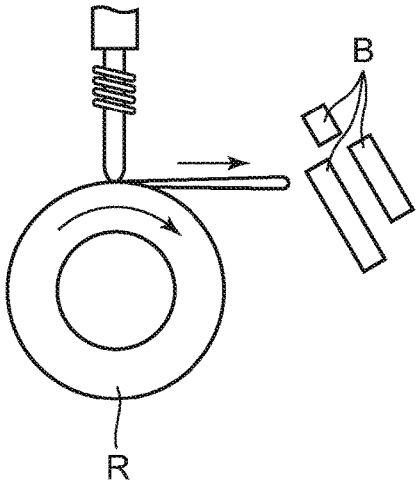
FIGS. 1A and 1B are schematic diagrams sequentially illustrating a first step of a method of manufacturing a rare earth magnet according to an embodiment of the invention.
Figure 1B:
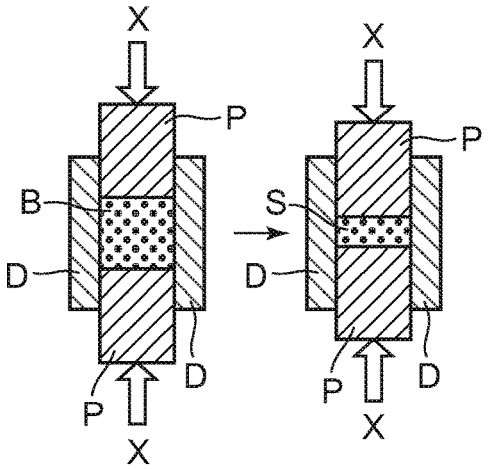
Figure 1C:
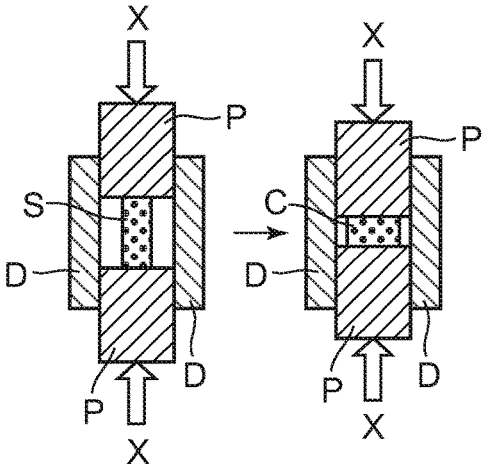
FIG. 1C is a schematic diagram illustrating a second step thereof.
Figure 2A:
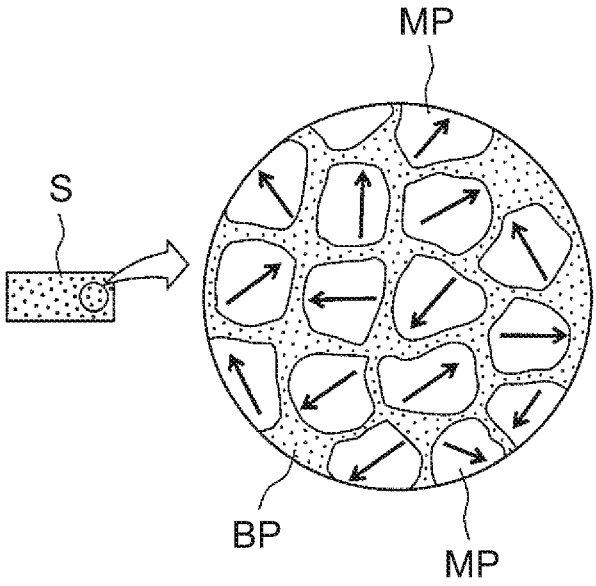
FIG. 2A is a diagram illustrating a microstructure of a sintered compact illustrated in FIG. 1B.
Figure 2B:
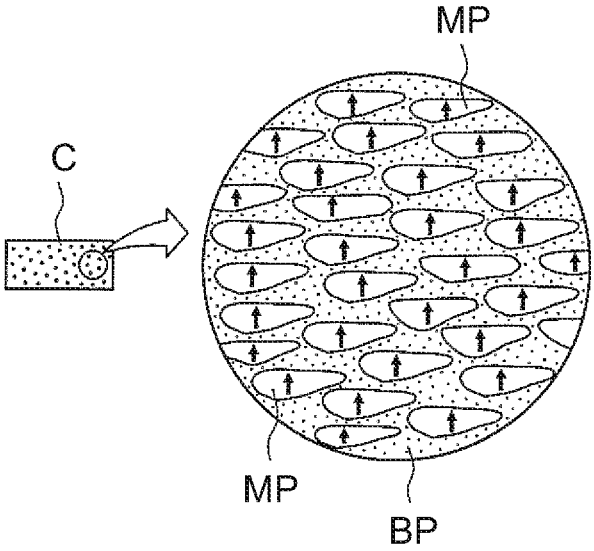
FIG. 2B is a diagram illustrating a microstructure of a rare earth magnet precursor illustrated in FIG. 1C.
Figure 3A:
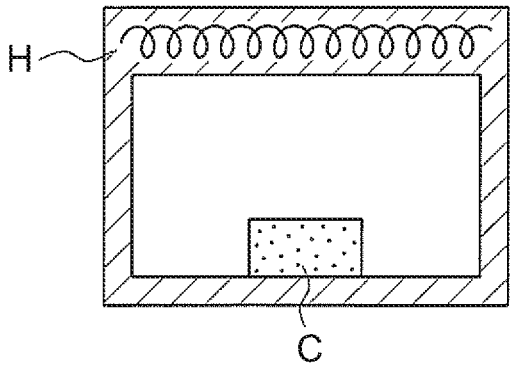
FIGS. 3A and 3B, are schematic diagrams illustrating a third step of the method of manufacturing a rare earth magnet according to the embodiment.
Figure 3B:
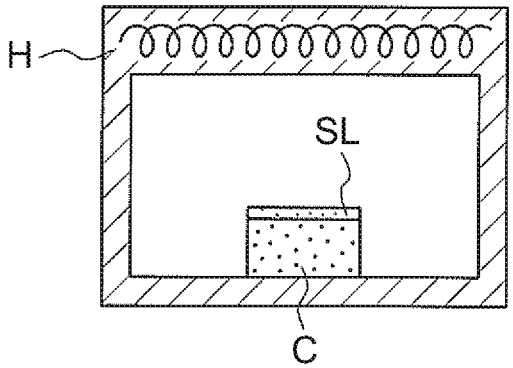
Figure 4:
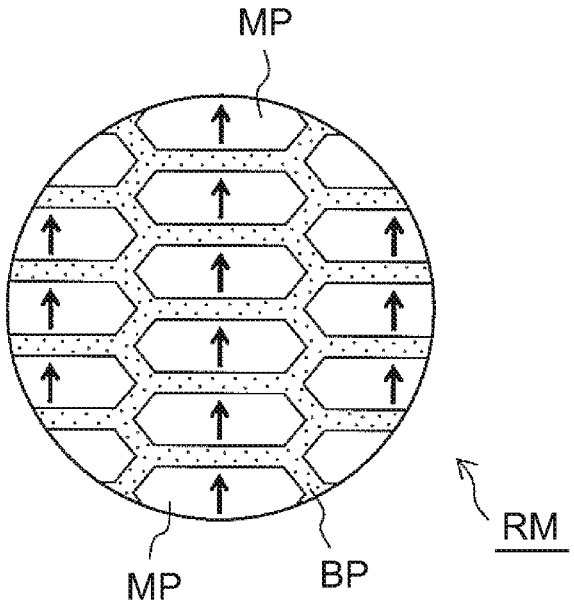
FIG. 4 is a diagram illustrating a microstructure of a crystal structure of the manufactured rare earth magnet.

FIGS. 1A and 1B are schematic diagrams sequentially illustrating a first step of a method of manufacturing a rare earth magnet according to an embodiment of the invention, and FIG. 1C is a schematic diagram illustrating a second step thereof. In addition, FIGS. 3A and 3B are schematic diagrams illustrating a third step of the method of manufacturing a rare earth magnet according to the embodiment. In addition, FIG. 2A is a diagram illustrating a microstructure of a sintered compact illustrated in FIG. 1B, and FIG. 2B is a diagram illustrating a microstructure of a rare earth magnet precursor illustrated in FIG. 1C. Further, FIG. 4 is a diagram illustrating a microstructure of a crystal structure of the manufactured rare earth magnet;

As illustrated in FIG. 1A, in a furnace (not illustrated) of an Ar gas atmosphere in which the pressure is reduced to, for example, 50 kPa or less, an alloy ingot is melted by high-frequency induction heating using a single-roll melt spinning method, and molten metal is injected to a copper roll R to prepare a rapidly-solidified ribbon B, and this rapidly-solidified ribbon B is crushed. Here, the molten metal has a composition constituting a rare earth magnet.

As illustrated in FIG. 1B, the crushed rapidly-solidified ribbon B is filled into a cavity which is partitioned by a cemented carbide die D and a cemented carbide punch P sliding in a hollow portion of the cemented carbide die D. Next, the crushed rapidly-solidified ribbon B is heated by causing a current to flow therethrough in a compression direction while being compressed with the cemented carbide punch P (X direction). As a result, a sintered compact S having a composition represented by $(Rl)_x(Rh)_yT_zB_sM_t$ is manufactured. Here, Rl represents at least one of light rare earth elements containing Y. Rh represents at least one of heavy rare earth elements containing Dy and Tb. T represents a transition metal containing at least one of Fe and Co. B represents boron. M represents at least one of Ga, Al, Cu, and Co. x, y, z, s, and t respectively represent percentages by mass of Rl, Rh, T, B, and M in the sintered compact. x, y, z, s, and t are expressed by the following expressions: $27 \le x \le 44$, $0 \le y \le 10$, $z = 100 - x - y - s - t$, $0.75 \le s \le 3.4$, $0 \le t \le 3$. The sintered compact S has a structure including a main phase and a grain boundary phase, and the main phase has a grain size of about 50 nm to 300 nm (hereinabove, the first step).

The grain boundary phase contains at least one of Ga, Al, Cu, and Co in addition to Nd or the like and is in a Nd-rich state. In addition, the grain boundary phase contains a Nd phase and a $Nd_{1.1}T_4B_4$ phase as major components, in which the content of the $Nd_{1.1}T_4B_4$ phase is controlled to be in a range of more than 0 mass % and 50 mass % or less.

As illustrated in FIG. 2A, the sintered compact S has an isotropic crystal structure in which a grain boundary phase BP is filled between nanocrystalline grains MP (main phase). In order to impart magnetic anisotropy to the sintered compact S, as illustrated in FIG. 1C, the cemented carbide punch P is brought into contact with an end surface of the sintered compact S in a longitudinal direction thereof (in FIG. 1B, the horizontal direction is the longitudinal direction) such that hot deformation processing is performed on the sintered compact S while being compressed with the cemented carbide punch P (X direction). As a result, a rare earth magnet precursor C which includes a crystal structure having the anisotropic nanocrystalline grains MP as illustrated in FIG. 2B is manufactured (hereinabove, the second step).

When the processing degree (compressibility) by the hot deformation processing is high, for example, when the compressibility is about 10% or higher; this processing may be called high hot deformation or simply high deformation. However, it is preferable that high deformation be performed at a compressibility of about 60% to 80%.

In a crystal structure of the rare earth magnet precursor C illustrated in FIG. 2B, the nanocrystalline grains MP have a flat shape, and the boundary surface which is substantially parallel to an anisotropic axis is curved or bent and is not configured of a specific surface.

Next, as illustrated in FIGS. 3A and 3B, the third step may be performed mainly using two methods.

In a method of manufacturing a rare earth magnet using a first embodiment of the third step, as illustrated in FIG. 3A, the rare earth magnet precursor C is put into a high-temperature furnace H, and only the aging treatment is performed on the rare earth magnet precursor C in a temperature range of 450° C. to 700° C.

The grain boundary phase constituting the rare earth magnet precursor C contains at least one of Ga, Al, Cu, and Co in addition to Nd or the like. As a result, the grain boundary phase BP can be melted and flow in a low temperature range of 450° C. to 700° C., and Nd or the like and Ga, Al, Cu, Co, or the like can be alloyed. That is, by alloying a transition metal element or the like and a light rare earth element contained in the grain boundary phase in advance, the same modification effects as in the case where the modified alloy is diffused and infiltrated can be exhibited without the necessity of diffusing and infiltrating the modified alloy into the surface of a magnet.

Further, by the grain boundary phase BP containing $Nd_{1.1}Fe_4B_4$ in a content range of 50 mass % or less, that is, by controlling the boron content (B content) in the grain boundary phase BP to be in a predetermined range, a decrease in the content of the main phase during the aging treatment is suppressed and thus a decrease in magnetization is suppressed.

As a result, the coercive force can be improved by the aging treatment, and a decrease in magnetization caused by the aging treatment can be suppressed. Accordingly, a rare earth magnet which is superior in both coercive force performance and magnetization performance can be manufactured.

On the other hand, in a method of manufacturing a rare earth magnet using a second embodiment of the third step, as illustrated in FIG. 3B, modified alloy powder SL is sprayed on the surface of the rare earth magnet precursor C, the rare earth magnet precursor C is put into a high-temperature furnace H, and the modified alloy SL is diffused and infiltrated while performing the aging treatment on the rare earth magnet precursor C in a temperature range of 450° C. to 700° C.

Regarding the modified alloy powder SL, a plate-shaped modified alloy powder may be placed on the surface of the rare earth magnet precursor, or a slurry of the modified alloy powder may be prepared and coated on the surface of the rare earth magnet precursor.

Here, a modified alloy which contains a light rare earth element and at least one of a transition metal element, In, Zn, Al, and Ga and has a low eutectic point of 450° C. to 700° C. is used as the modified alloy powder SL. As the modified alloy powder SL, any one of a Nd—Cu alloy (eutectic point: 520° C.), a Pr—Cu alloy (eutectic point: 480° C.), a Nd—Pr—Cu alloy, a Nd—Al alloy (eutectic point: 640° C.), a Pr—Al alloy (eutectic point: 650° C.), a Nd—Pr—Al alloy, a Nd—Co alloy (eutectic point: 566° C.), a Pr—Co alloy (eutectic point: 540° C.), and a Nd—Pr—Co alloy is preferably used. Among these, alloys having a low eutectic point of 580° C. or lower, for example, a Nd—Cu alloy (eutectic point: 520° C.), a Pr—Cu alloy (eutectic point: 480° C.), a Nd—Co alloy (eutectic point: 566° C.), and a Pr—Co alloy (eutectic point: 540° C.) are more preferably used.

By diffusing and infiltrating the modified alloy into the grain boundary phase in this way, the grain boundary phase BP of, particularly, the surface region of the rare earth magnet precursor C can be further modified. That is, the grain boundary phase BP of the entire region of the rare earth magnet precursor C can be modified by the alloying of a transition metal element or the like and a light rare earth element in the grain boundary phase BP. Therefore, it is not necessary that the non-magnetic modified alloy SL be diffused and infiltrated into the center region of the rare earth magnet precursor C to modify the grain boundary phase BP. In this way, the modification of the grain boundary phase BP by the modified alloy SL is only necessary for the surface region of the rare earth magnet precursor C. Therefore, it is sufficient that the amount of the modified alloy SL to be diffused and infiltrated be less than 5 mass % with respect to the rare earth magnet precursor C. In addition, the high-temperature holding time during the aging treatment can be made to be short, for example, in a range of 5 minutes to 180 minutes and preferably in a range of 30 minutes to 180 minutes. Since the infiltration amount of the modified alloy SL can be made to be small, the material cost can be reduced as compared to the diffusion and infiltration treatment method of the modified alloy of the related art. In addition, since the holding time during the aging treatment can be made to be short, the manufacturing time can be reduced.

No matter which method is used among the methods according to the first embodiment or the second embodiment of the third step, Nd or the like and at least one of Ga, Al, Cu, and Co present in the grain boundary phase of the rare earth magnet precursor C in advance are alloyed by the aging treatment to modify the grain boundary BP. Further, by a predetermined amount of boron being present in the grain boundary phase BP, the crystal structure of the rare earth magnet precursor C illustrated in FIG. 2B is changed, and the boundary surface of the crystal grains MP is cleared as illustrated in FIG. 4. Therefore, the crystal grains MP are magnetically isolated from each other, and a rare earth magnet RM having an improved coercive force is manufactured (third step). In an intermediate step of the structure modification by the modified alloy illustrated in FIG. 4, a boundary surface which is substantially parallel to an anisotropic axis is not formed (is not configured of a specific surface). On the other hand, in a step in which the modification by the modified alloy sufficiently progresses, a boundary surface (specific surface) which is substantially parallel to an anisotropic axis is formed, and a rare earth magnet in which the shape of the crystal grains MP is rectangular or substantially rectangular when seen from a direction perpendicular to the anisotropic axis is manufactured.

[Experiment for Verifying Magnetic Properties of Rare Earth Magnet While Changing Content of $(RlRh)_{1.1}T_4B_4$ Phase in Grain Boundary Phase to Specify Optimal Content Range of $(RlRh)_{1.1}T_4B_4$ Phase, and Results Thereof]

The present inventors performed an experiment for specifying an optimal content range of the $(RlRh)_{1.1}T_4B_4$ phase, in which various rare earth magnets containing a $Nd_{1.1}T_4B_4$ phase as a specific example of the $(RlRh)_{1.1}T_4B_4$ phase and containing a Nd phase were manufactured, and magnetic properties of each test piece were measured.

Examples 1 to 5

Figure 5:
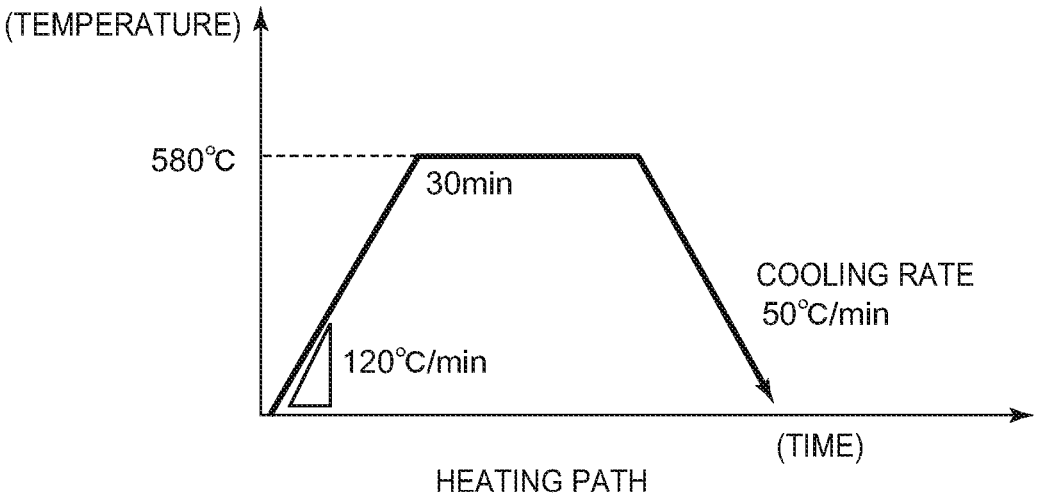
FIG. 5 is a diagram illustrating a heating path of the third step during the manufacture of test pieces of Examples 1 to 5 and Comparative Examples 1 to 7.

A liquid rapidly-solidified ribbon having a composition represented by $Nd_{28.9}Pr_{0.4}Fe_{bal}B_{0.96+a}Ga_{0.4}Al_{0.1}Cu_{0.1}$ was prepared in a single-roll furnace (a=0, 0.03, 0.04, 0.05, 0.06), the obtained rapidly-solidified ribbon was sintered to prepare a sintered compact (sintering temperature: 650° C.; 400 MPa), and high deformation (processing temperature: 750° C.; processing degree: 75%) was performed on the sintered compact, thereby preparing a rare earth magnet precursor. Next, an aging treatment was performed on the obtained rare earth magnet precursor according to a heating path illustrated in FIG. 5.

Comparative Examples 1 to 7

A liquid rapidly-solidified ribbon having a composition represented by $Nd_{28.9}Pr_{0.4}Fe_{bal}B_{0.96+a}Ga_{0.4}Al_{0.1}Cu_{0.1}$ was prepared in a single-roll furnace (a=−0, 08.−0.07, −0.06, −0.05, −0.03, 0.14, 0.24), the obtained rapidly-solidified ribbon was sintered to prepare a sintered compact (sintering temperature: 650° C.; 400 MPa), and high deformation (processing temperature: 750° C.; processing degree: 75%) was performed on the sintered compact, thereby preparing a rare earth magnet precursor. Next, an aging treatment was performed on the obtained rare earth magnet precursor according to a heating path illustrated in FIG. 5. The magnetic properties were evaluated using a vibrating sample magnetometer (VSM) and a pulsed high field magnetometer (TPM).

(Experiment Results)

Figure 6:
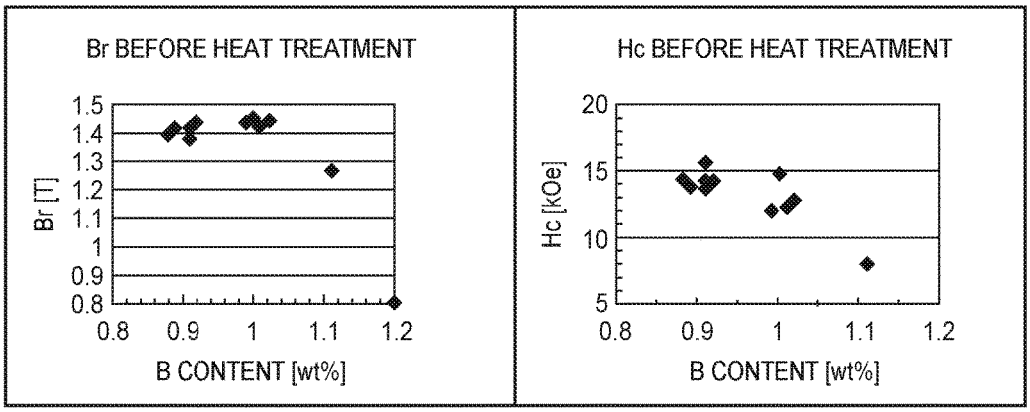
FIG. 6 is a diagram illustrating a relationship between the B content after hot deformation processing and remanent magnetization and coercive force.
Figure 7:
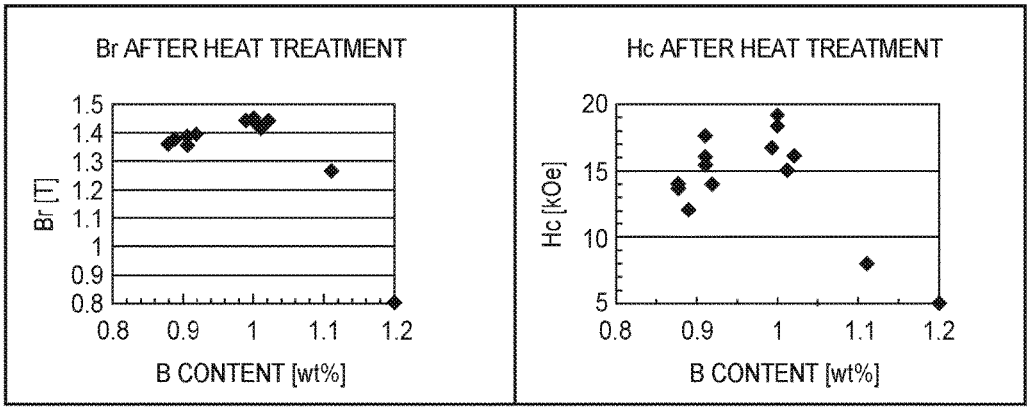
FIG. 7 is a diagram illustrating a relationship between the B content after an aging treatment and remanent magnetization and coercive force.
Figure 8:
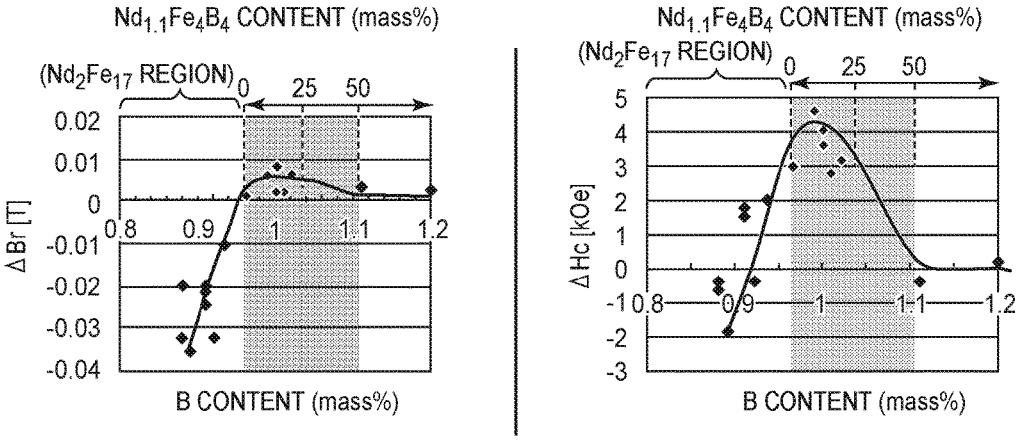
FIG. 8 is a diagram illustrating a relationship between the B content and variations in remanent magnetization and coercive force before and after hot deformation processing and illustrating the optimum content of a $Nd_{1.1}T_4B_4$ phase.

The experiment results are shown in FIGS. 6 to 8. Here, FIG. 6 is a diagram illustrating a relationship between the B content after hot deformation processing and remanent magnetization and coercive force, and FIG. 7 is a diagram illustrating a relationship between the B content after an aging treatment and remanent magnetization and coercive force. In addition, FIG. 8 is a diagram illustrating a relationship between the B content and variations in remanent magnetization and coercive force before and after hot deformation processing and illustrating the optimum content of a $Nd_{1.1}T_4B_4$ phase.

In this experiment, the content of the main phase was 95 mass %, and thus the content of the grain boundary phase was 5 mass %. It was found from FIG. 8 that, when the content range of the $Nd_{1.1}T_4B_4$ phase in the grain boundary phase was in a range of more than 0 mass % and 50 mass % or less, there was no change in remanent magnetization before and after the hot deformation processing, that is, the remanent magnetization was not reduced by the aging treatment, and the coercive force increased.

On the other hand, it was found that, when the grain boundary phase did not contain $Nd_{1.1}T_4B_4$ phase and the grain boundary phase contained a Nd phase and a $Nd2Fe_{17}$ phase, the content of the main phase decreased due to the absence of boron in the grain boundary phase, and the remanent magnetization decreased. In addition, when the content of the $Nd_{1.1}T_4B_4$ phase was more than 50 mass %, the remanent magnetization did not decrease, and both the remanent magnetization and the coercive force did not increase.

Based on these experiment results, the content of the $(RlRh)_{1.1}T_4B_4$ phase in the grain boundary phase was defined to be in a range of more than 0 mass % and 50 mass % or less.

[Experiment for Verifying Effects when Aging Treatment and Diffusion and Infiltration Treatment of Modified Alloy were Simultaneously Performed, and Results Thereof]

The present inventors performed an experiment for verifying effects when aging treatment and diffusion and infiltration treatment of a modified alloy were simultaneously performed.

Examples 6 and 7

A liquid rapidly-solidified ribbon having a composition represented by $Nd_{28.9}Pr_{0.4}Fe_{bal}B_{0.96+a}Ga_{0.4}Al_{0.1}Cu_{0.1}$ was prepared in a single-roll furnace (a=0, 0.04). In this case, when a=0, the B content was 0.96% and the $Nd_{1.1}Fe_4B_4$ content was 0%; and when a=0.4, the B content was 1.00% and the $Nd_{1.1}Fe_4B_4$ content was 14.3%. Next, the obtained rapidly-solidified ribbon was sintered to prepare a sintered compact (sintering temperature: 650° C.; 400 MPa), and high deformation (processing temperature: 750° C.; processing degree: 75%) was performed on the sintered compact, thereby preparing a rare earth magnet precursor. Next, a heat treatment was performed on the obtained rare earth magnet precursor according to "Method A" such that 3.5 mass % of a Nd—Cu alloy was diffused and infiltrated thereinto (as the modified alloy, a Nd70Cu30 alloy was used).

Here, "Method A" refers to a method in which the aging treatment and the diffusion and infiltration treatment of the modified alloy are simultaneously performed. In this method, the rare earth magnet precursor is cut into a block having a size of 1 mm×1 mm×1 mm, and magnetic properties thereof are evaluated using a VSM and a TPM. Then, in a state where 3.5 mass % of a Nd—Cu alloy is in contact with the surface of the block, the block is put into a high-temperature furnace and is extracted after being held at 580° C. for 300 minutes in an atmosphere of $10^{-3}$ Pa, and then magnetic properties thereof are evaluated again.

Comparative Examples 8 and 9

A liquid rapidly-solidified ribbon having a composition represented by $Nd_{28.9}Pr_{0.4}Fe_{bal}B_{0.96+a}Ga_{0.4}Al_{0.1}Cu_{0.1}$ was prepared in a single-roll furnace (a=0, 0.04, 0.20). In this case, when a=0, the B content was 0.96% and the $Nd_{1.1}Fe_4B_4$ content was 0%; when a=0.4, the B content was 1.00% and the $Nd_{1.1}Fe_4B_4$ content was 14.3%; and when a=0.20, the B content was 1.16% and the $Nd_{1.1}Fe_4B_4$ content was 71.5%. Next, the obtained rapidly-solidified ribbon was sintered to prepare a sintered compact (sintering temperature: 650° C.; 400 MPa), and high deformation (processing temperature: 750° C.; processing degree: 75%) was performed on the sintered compact, thereby preparing a rare earth magnet precursor. Next, a heat treatment was performed on the obtained rare earth magnet precursor according to "Method B" such that 3.5 mass % of a Nd—Cu alloy was diffused and infiltrated thereinto (as the modified alloy, a Nd70Cu30 alloy was used).

Here, "Method B" refers to a method in which the aging treatment and the diffusion and infiltration treatment of the modified alloy are not simultaneously performed. In this method, the rare earth magnet precursor is cut into a block having a size of 1 mm×1 mm×1 mm, and magnetic properties thereof are evaluated using a VSM and a TPM. Then, the block is put into a high-temperature furnace and is extracted after being held at 580° C. for 30 minutes in an atmosphere of $10^{-3}$ Pa for an aging treatment. Next, in a state where 3.5 mass % of a Nd—Cu alloy is in contact with the surface of the block subjected to the aging treatment, the block is put again into a high-temperature furnace and is extracted after being held at 580° C. for 300 minutes in an atmosphere of $10^{-3}$ Pa, and then magnetic properties thereof are evaluated again.

(Experiment Results)

Figure 9:
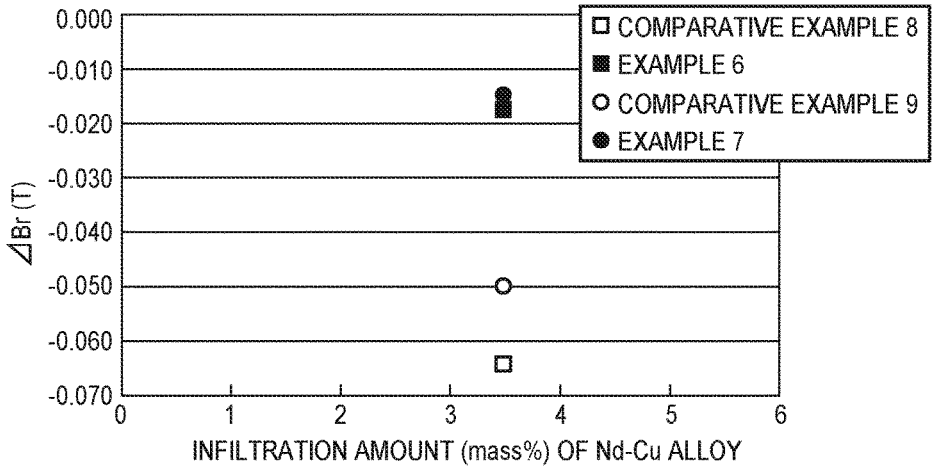
FIG. 9 is a diagram illustrating variations in magnetization after a heat treatment in a case where the aging treatment and the diffusion and infiltration treatment of the modified alloy were simultaneously performed and a case where the above-described treatments were not simultaneously performed.
Figure 10:
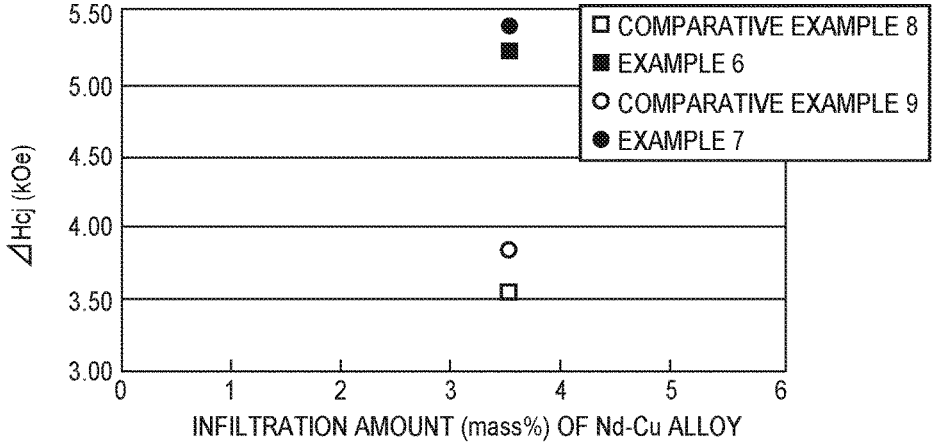
FIG. 10 is a diagram illustrating variations in coercive force after a heat treatment in a case where the aging treatment and the diffusion and infiltration treatment of the modified alloy were simultaneously performed and a case where the above-described treatments were not simultaneously performed.

FIGS. 9 and 10 are diagrams illustrating variations in magnetization and variations in coercive force, respectively, after a heat treatment in a case where the aging treatment and the diffusion and infiltration treatment of the modified alloy were simultaneously performed and a case where the above-described treatments were not simultaneously performed. In addition, FIGS. 11 and 12 are diagrams illustrating variations in magnetization and variations in coercive force, respectively, after a heat treatment in a case where the aging treatment and the diffusion and infiltration treatment of the modified alloy were simultaneously performed while changing the boron content (B content) and a case where the above-described treatments were not simultaneously performed while changing the boron content (B content).

First, it was verified from FIGS. 9 and 10 that, in Examples 6 and 7 in which the aging treatment and the diffusion and infiltration treatment of the modified alloy were simultaneously performed, a decrease in remanent magnetization was significantly decreased to about ⅕ to ¼ and the coercive force was increased by about 50% as compared to those of Comparative Examples 8 and 9 in which the above-described treatments were not simultaneously performed.

Figure 11:
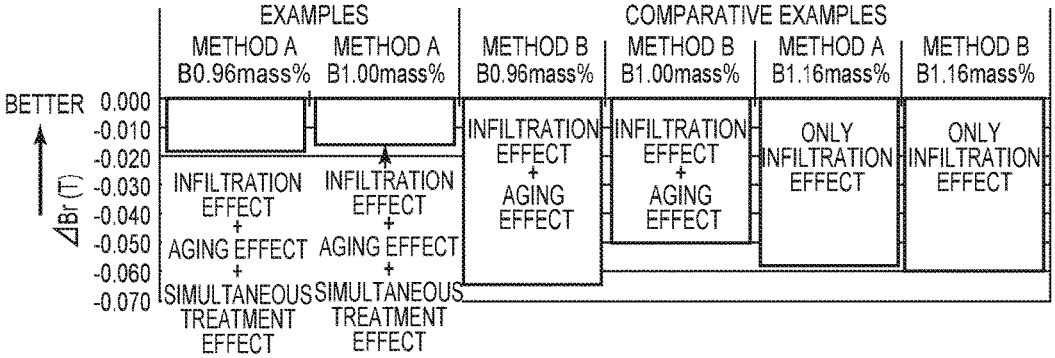
FIG. 11 is a diagram illustrating variations in magnetization after a heat treatment in a case where the aging treatment and the diffusion and infiltration treatment of the modified alloy were simultaneously performed while changing the boron content (B content) and a case where the above-described treatments were not simultaneously performed while changing the boron content (B, content)
Figure 12:
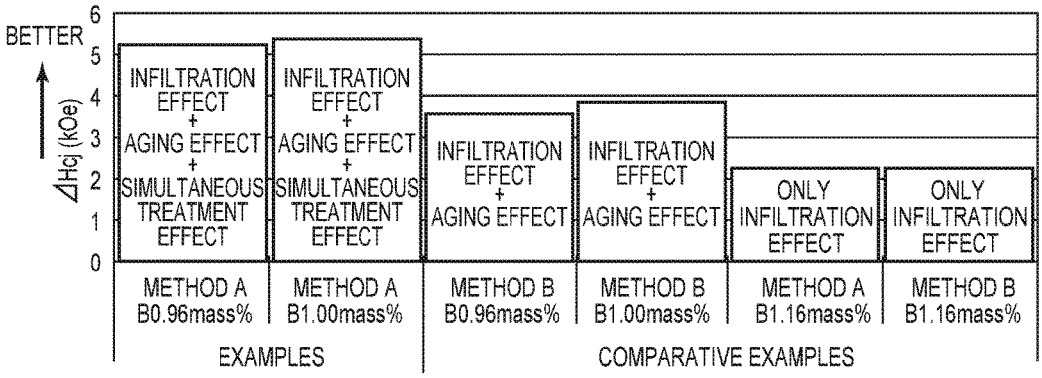
FIG. 12 is a diagram illustrating variations in coercive force after a heat treatment in a case where the aging treatment and the diffusion and infiltration treatment of the modified alloy were simultaneously performed while changing the boron content (B content) and a case where the above-described treatments were not simultaneously performed while changing the boron content (B content)

In addition, it was verified from FIGS. 11 and 12 that, in the method in which the aging treatment and the diffusion and infiltration treatment of the modified alloy were simultaneously performed, the effect of suppressing a decrease in remanent magnetization by the heat treatment was higher and the effect of improving the coercive force was higher as compared to those of the method in which the above treatments were separately performed or the method in which only the diffusion and infiltration of the modified alloy was performed.

Figure 13:
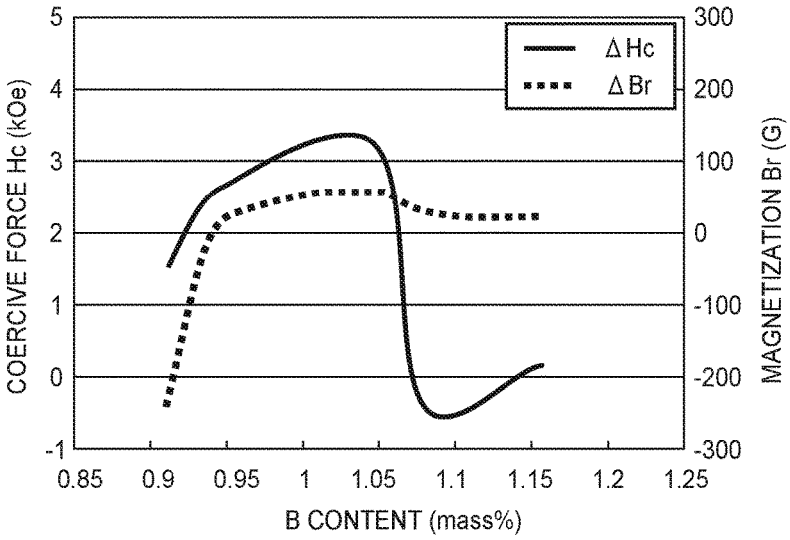
FIG. 13 is a diagram illustrating changes in magnetization and coercive force during a heat treatment depending on the change in the boron content (B content).

FIG. 13 is a diagram illustrating changes in magnetization and coercive force during a heat treatment depending on the change in the boron content (B content). In this experiment, the content of the main phase was 95 mass %, and the content of the grain boundary phase was 5 mass %.

It was found from FIG. 13 that, when the B content was in a range of 0.95 mass % to 1.05 mass %, both the coercive force and the remanent magnetization were increased by the aging treatment. When the B content was less than 0.95 mass %, magnetic properties decreased due to the appearance of soft-magnetic $Nd_2Fe_{17}$, and when the B content was more than 1.05 mass %, magnetic properties also decreased due to an excessively large amount of $Nd_{1.1}Fe_4B_4$.

The reason why the coercive force is improved and a decrease in magnetization is suppressed by simultaneously performing the aging treatment and the diffusion and infiltration treatment of the modified alloy is presumed to be as follows: the coarsening of crystal grains is suppressed due to a short heating history; and when the Nd—Cu alloy is infiltrated in a state where the grain boundary phase before the heat treatment is incomplete (in a Fe rich state), a gradient of the Nd concentration is large, and thus the Nd—Cu alloy is easily infiltrated.

Hereinabove, the embodiments of the invention have been described with reference to the drawings. However, a specific configuration is not limited to the embodiments, and design changes and the like which are made within a range not departing from the scope of the invention are included in the invention.

The invention claimed is:

1. A method of manufacturing a rare earth magnet comprising:

manufacturing a sintered compact having a structure represented by a composition of $(Rl)_x(Rh)_yT_zB_sM_t$, wherein a main phase of the structure is formed of a $(RlRh)_2Ti_4B$ phase, and a content of a $(RlRh)_{1.1}T_4B_4$ phase in a grain boundary phase of the structure is more than 0 mass % and less than 25 mass %;

manufacturing a rare earth magnet precursor by performing hot deformation processing on the sintered compact; and manufacturing a rare earth magnet by performing an aging treatment on the rare earth magnet precursor in a temperature range of 450° C. to 700° C., wherein Rl represents at least one light rare earth element or Y, Rh represents Dy or Tb, T represents a transition metal and T is at least one of Fe and Co, B represents boron, M represents at least one of Ga, Al, Cu, and Co, x, y, z, s, and t respectively represent percentages by mass of Rl, Rh, T, B, and M in the sintered compact, and x, y, z, s, and t are expressed by the following expressions:

$$27 \le x \le 44,\ 0 \le y \le 10,\ z = 100 - x - y - s - t,\ 0.96 \le s \le 1.02,\ 0 \le t \le 3.$$

2. The method according to claim 1, wherein during the aging treatment, a modified alloy containing a light rare earth element and at least one of a transition metal element, In, Zn, Al, and Ga is diffused and infiltrated into the grain boundary phase.

* * * * *